US006474770B1

(12) United States Patent
Endo

(10) Patent No.: US 6,474,770 B1
(45) Date of Patent: Nov. 5, 2002

(54) ADJUSTMENT OF INK DROPLET EXPULSION TESTING DEVICE IN PRINTER

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 196 days.

(21) Appl. No.: 09/690,733

(22) Filed: Oct. 18, 2000

(30) Foreign Application Priority Data

Oct. 19, 1999 (JP) ..... 11-296174

(51) Int. Cl.[7] ..... B41J 2/01
(52) U.S. Cl. ..... 347/19
(58) Field of Search ..... 347/19; 400/74; 250/573, 574

(56) References Cited

U.S. PATENT DOCUMENTS 5,434,430 A * 7/1995 Stewart ..... 250/573
5,517,217 A 5/1996 Haselby et al.
6,224,183 B1 * 5/2001 Kono et al. ..... 347/19
6,350,006 B1 * 2/2002 Muller et al. ..... 347/19

FOREIGN PATENT DOCUMENTS

| | | |
|---|---|---|
| EP | 0 744 295 | 11/1996 |
| JP | 10-119307 | 5/1998 |
| JP | 11-179884 | 7/1999 |
| JP | 11-188853 | 7/1999 |

* cited by examiner

*Primary Examiner*—Craig Hallacher
(74) *Attorney, Agent, or Firm*—Oblon, Spivak, McClelland, Maier & Neustadt, P.C.

(57) ABSTRACT

The printer has a photo-emitter unit, a photo-receptor unit and a controller. The photo-emitter unit includes a photo sensor having a gain adjustment terminal and an output signal terminal. It also includes a variable voltage supply unit that is connected to the gain adjustment terminal and can supply variable voltage signal to the gain adjustment terminal. The controller detects an output signal of the photo sensor while the voltage level of the variable voltage signal is being changed, and sets the voltage level of the variable output signal to a level appropriate for ink droplet expulsion testing, based on the relationship between the voltage level of the variable voltage signal and the output signal of the photo sensor.

9 Claims, 11 Drawing Sheets

FLYING INK DROPLET TEST METHOD

DETECTION NOT POSSIBLE (Vin=Vin1>>Vth)

UPPER LIMIT FOR INDIVIDUAL INK DROPLET DETECTION
(Vin=Vin2<Vth)

LOWER LIMIT FOR INDIVIDUAL INK DROPLET DETECTION
(Vin=Vin3<Vin2)

MARGIN FOR INK DROP DETECTION (Vin=Vin4<Vin3)

VARIABLE VOLTAGE SUPPLY CIRCUIT 206

ADJUSTMENT OF INK DROPLET EXPULSION TESTING DEVICE IN PRINTER

BACKGROUND OF THE INVENTION

1. Field of the Invention

The present invention relates to a technology for testing whether or not ink droplets are expelled in printers, and more particularly to an adjustment technology for testing devices that perform such testing.

2. Description of the Related Art

Inkjet printers print images by expelling ink droplets from a plurality of nozzles. The print head of an inkjet printer has many nozzles, but due to such causes as increased viscosity of the ink or inclusion of air bubbles, some of the nozzles may become clogged up and no longer able to expel ink droplets. If the nozzles are clogged, the image includes missing dots, which results in a deterioration in image quality.

As a device that tests whether or not ink droplets are being expelled, a testing device using light has been proposed. FIG. 11 shows a concept drawing showing one example of a conventional ink droplet expulsion testing device using light. This testing device has a photo-emitter unit 302 and a photo-receptor unit 304. The photo-emitter unit 302 emits light L such that the light crosses the locus of the ink droplets Ip expelled intermittently from the print head 300 of the printer.

The photo-receptor unit 304 has a photo sensor 306. A so-called gain resistor Rg is connected between a gain adjustment terminal Pa of the photo sensor 306 and a power source voltage Vcc. An output signal Vout is output from an output signal terminal Pb of the photo sensor 306.

The sensitivity of the photo sensor 306 is adjusted by setting the value of the gain resistor Rg to an appropriate level in advance. In other words, where an appropriate adjustment is achieved, the output signals Vout from the photo sensor 306 alternate between the ON level and the OFF level depending on whether or not the ink droplet Ip blocks the light L.

However, in conventional devices of this type, there are situations in which, even if the value of the gain resistor Rg is set to an appropriate level in advance, the photo sensor 306 does not function well when the environment conditions are changed.

SUMMARY OF THE INVENTION

Accordingly, an object of the present invention is to provide a technology by which an ink droplet expulsion testing device using light may be appropriately adjusted even when the environment conditions are changed.

In order to attain at least part of the above and other related objects of the present invention, there is provided a testing device to test whether or not ink droplets are expelled from a print head in a printer. The testing device comprises: a photo-emitter unit configured to emit light such that the light crosses a locus of the ink droplets; a photo-receptor unit configured to receive the light that has crossed the locus of the ink droplets, and a controller configured to control the photo-emitter unit and the photo-receptor unit. The photo-receptor unit includes: (i) a photo sensor having a gain adjustment terminal and an output signal terminal; and (ii) a variable voltage supply unit configured to supply a variable voltage signal to the gain adjustment terminal. The controller detects an output signal from the output signal terminal of the photo sensor while changing a voltage level of the variable voltage signal output from the variable voltage supply unit, and sets the variable voltage signal to an appropriate level for the ink droplet expulsion test before the test is carried out, in accordance with the relationship between the voltage level of the variable voltage signal and the output signal of the photo sensor.

In the above arrangement, the voltage level of the variable voltage signals can be adjusted to an appropriate level for the expulsion test, and the testing device can accordingly be appropriately adjusted even when the environment conditions are changed.

The variable voltage supply unit may includes a D-A converter, which has an input terminal for receiving a digital input signal and an output terminal for outputting the variable voltage signal. In this case, the controller may adjust the voltage level of the variable voltage signal output from the D-A converter by adjusting the digital input signal supplied to the D-A converter.

Using a D-A converter, the voltage level of the variable voltage signal can be adjusted by means of a minute adjustment range, and therefore the voltage level may be set to an appropriate level in response to the environment conditions. In addition, since a digital signal is transmitted between the controller and the D-A converter even if they are some distance apart, noise impact can be easily avoided.

The variable voltage supply unit may further include a voltage controlled current source having a voltage input terminal and a current output terminal, where the voltage input terminal is connected to the output terminal of the D-A converter, and the current output terminal is connected to a node between the output terminal of the D-A converter and the gain adjustment terminal of the photo-receptor unit.

In this structure, a more stable adjustment may be carried out.

The controller may execute: (i) determining a threshold value at which a level of the output signal of the photo sensor changes from a prescribed first level to a prescribed second level while monotonically changing the digital input signal supplied to the D-A converter; (ii) determining a calibrated value for the digital input signal by adding a prescribed difference to the threshold value; and (iii) inputting the digital input signal having the calibrated value to the D-A converter in order to set the variable voltage signal to an appropriate level.

In this way, the variable voltage signals can easily be set to an appropriate level.

The present invention may be realized in various forms, such as an ink droplet expulsion testing device, an adjustment method therefor, a printer having the above testing device, a computer program to realize these methods or device functions in computers, a recording medium in which the computer program is recorded, and data signals embodied in a carrier wave including the computer program.

These and other objects, features, aspects, and advantages of the present invention will become more apparent from the following detailed description of the preferred embodiments with the accompanying drawings.

DESCRIPTION OF THE PREFERRED EMBODIMENT

Preferred embodiments of the present invention are explained below in the following order.

A. Construction of device:

B. Construction and principle of dot dropout inspection unit:

C. First embodiment:

D. Second embodiment:

E. Third embodiment:

F. Variations:

A. Construction of Device

Figure 1:
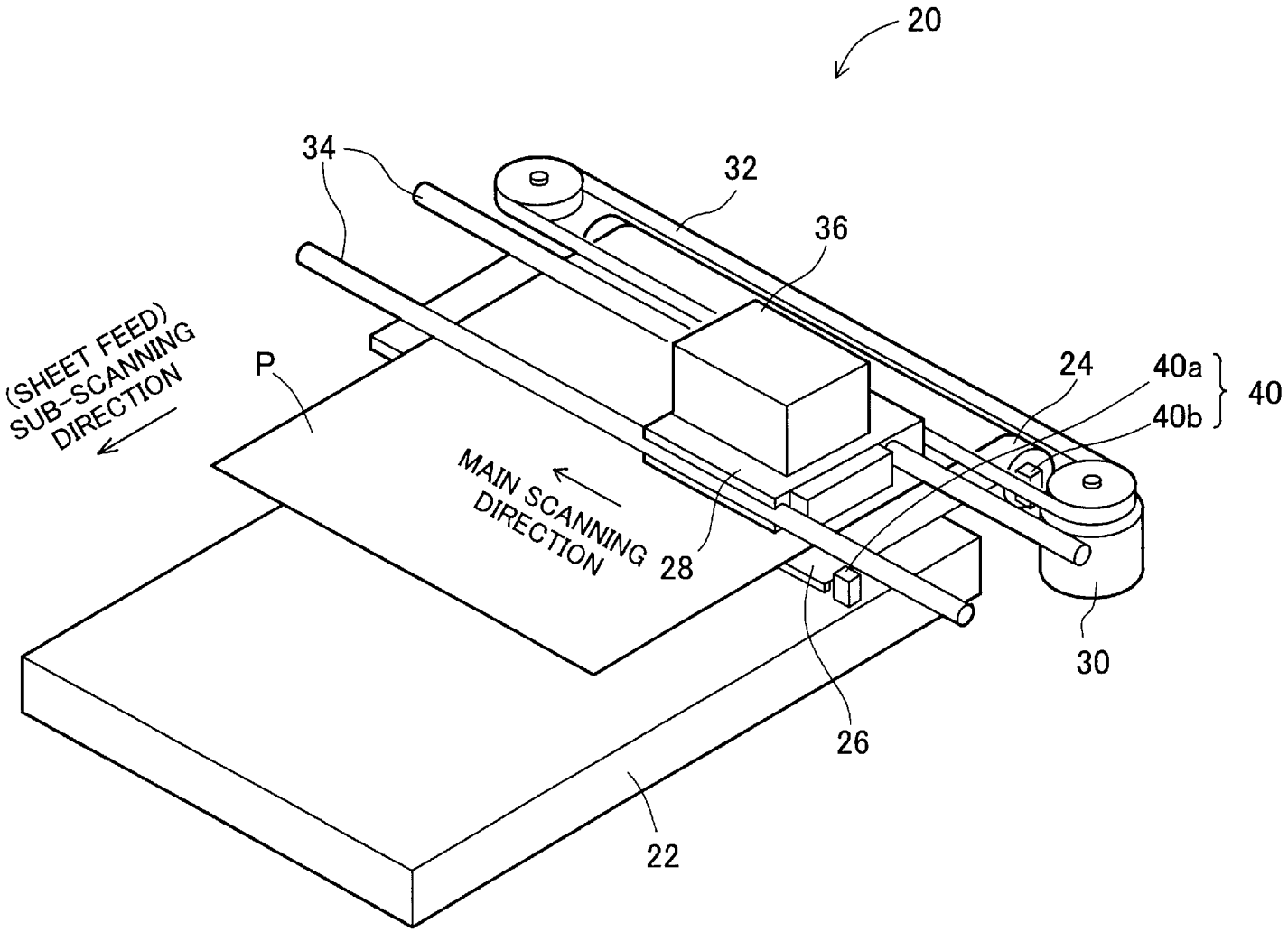
FIG. 1 is a summary perspective view showing the construction of the main components of a color inkjet printer 20, which comprises one embodiment of the present invention.

FIG. 1 is a perspective view showing the construction of the main components of a color inkjet printer 20, one embodiment of the present invention. This printer 20 comprises a sheet stacker 22, a paper feed roller 24 driven by a step motor not shown in the drawing, a platen plate 26, a carriage 28, a step motor 30, a traction belt 32 driven by the step motor 30, and guide rails 34 for the carriage 28. A print head 36 having many nozzles is mounted on the carriage 28.

A dot dropout inspection unit 40 is located at the standby position of the carriage 28, which is at the right-hand corner in FIG. 1. The dot dropout inspection unit 40 comprises a photo-emitter unit 40*a* and a photo-receptor unit 40*b*. The inspection unit 40 checks the flying state of the ink droplets using light in order to determine whether some ink dots are missing on a printing paper. Details regarding the testing carried out by this dot dropout inspection unit 40 are explained later in detail. In this specification, the two terms "dot dropout inspection" and "ink droplet expulsion testing" have the same meaning.

The print sheet P is taken in by the paper feed roller 24 from the sheet stacker 22, and is conveyed on the surface of the platen plate 26 in the sub-scanning direction. The carriage 28 is pulled by the traction belt 32 that is driven by the step motor 30, and moves in the main scanning direction along the guide rails 34. The main scanning direction is perpendicular to the sub-scanning direction.

Figure 2:
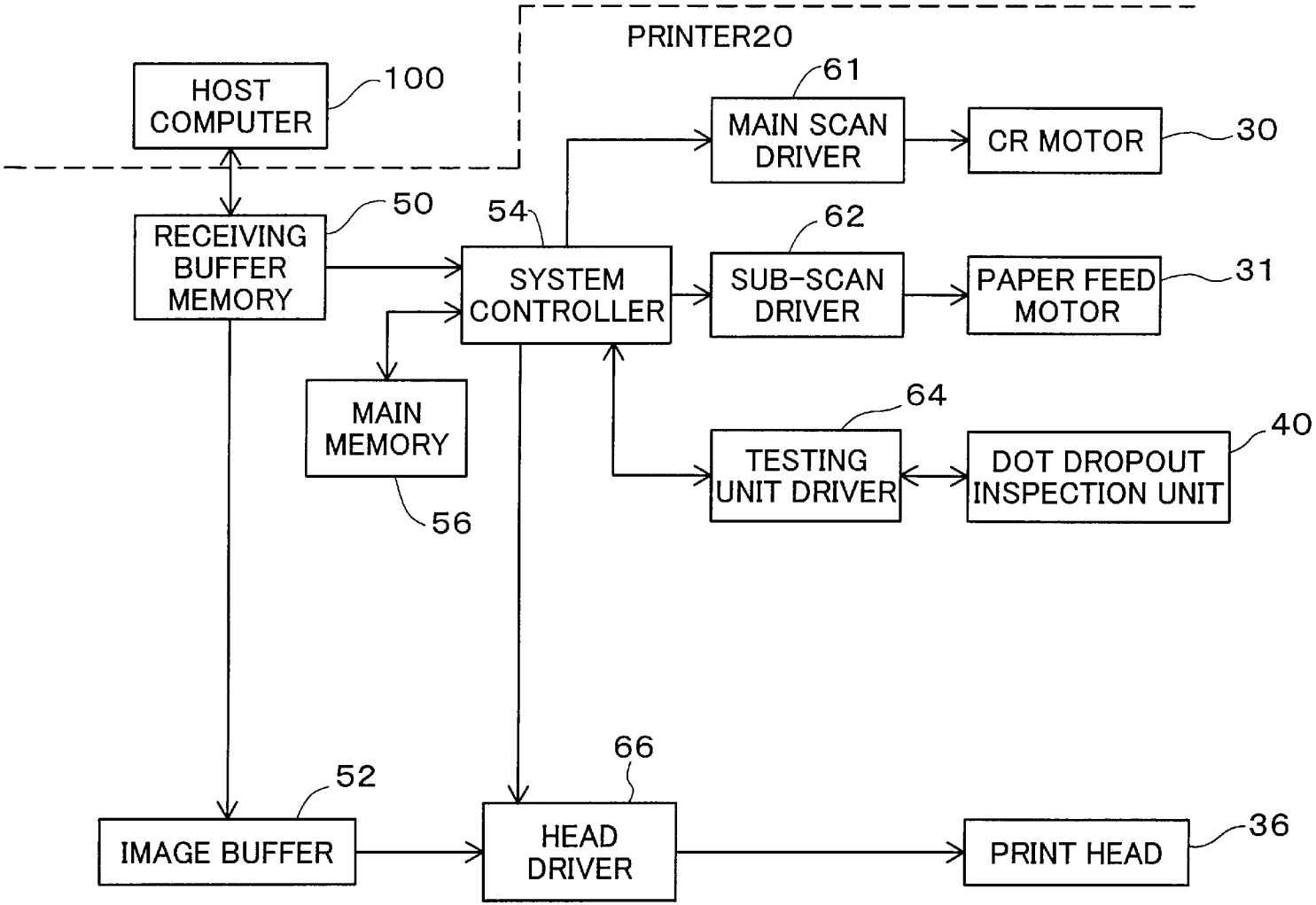
FIG. 2 is a block diagram showing the electrical construction of the printer 20.

FIG. 2 is a block diagram showing the electrical construction of the printer 20. The printer 20 comprises a receiving buffer memory 50 that receives signals supplied from the host computer 100, an image buffer 52 that stores print data, a system controller 54 that controls the operation of the entire printer 20, and a main memory 56. The system controller 54 is connected to a main scan driver that drives the carriage motor 30, a sub-scan driver 62 that drives the paper feed motor 31, a inspection unit driver 64 that drives the dot dropout inspection unit 40, and a head drive driver 66 that drives the print head 36,.

The printer driver (not shown in the drawings) in the host computer 100 determines various parameter values that define the printing operation based on the print mode (fast print mode, high image quality print mode, etc.) designated by the user. Based on these parameter values, the printer driver generates print data to perform printing in the specified print mode, and transfers the print data to the printer 20. The transferred print data is saved in the receiving buffer memory 50. In the printer 20, the system controller 54 reads out from the receiving buffer memory 50 necessary information from the print data, and sends a control signal to each driver based on this data.

Multiple color components of the print data, which are obtained by breaking down the print data received by the receiving buffer memory 50 into each color component, are stored in the image buffer 52. The head drive driver 56 reads out the print data for each color component from the image buffer 52 based on the control signals from the system controller 54, and accordingly drives the nozzle array for each color in the print head 36.

The system controller 54 realizes various functions, including the dot dropout inspection function and the adjustment function of the dot dropout inspection unit 40, by executing the computer program stored in the main memory 56.

The computer program that realizes the various functions of the system controller 54 is provided in a form recorded on a computer-readable recording medium, such as a flexible disk or CD-ROM. The host computer 100 may read the computer program from the recording medium and transfer it to the main memory 56 of the printer 20.

For the 'recording medium' in the present invention, various types of computer-readable media may be used, including flexible disks, CD-ROMs, magneto-optical disks, IC cards, ROM cartridges, punch cards, and printed matter on which symbols such as bar codes are printed, as well as computer internal memory devices (such as RAMs and ROMs), and external memory devices.

B. Construction and Principle of Dot Dropout Inspection Unit

Figure 3:
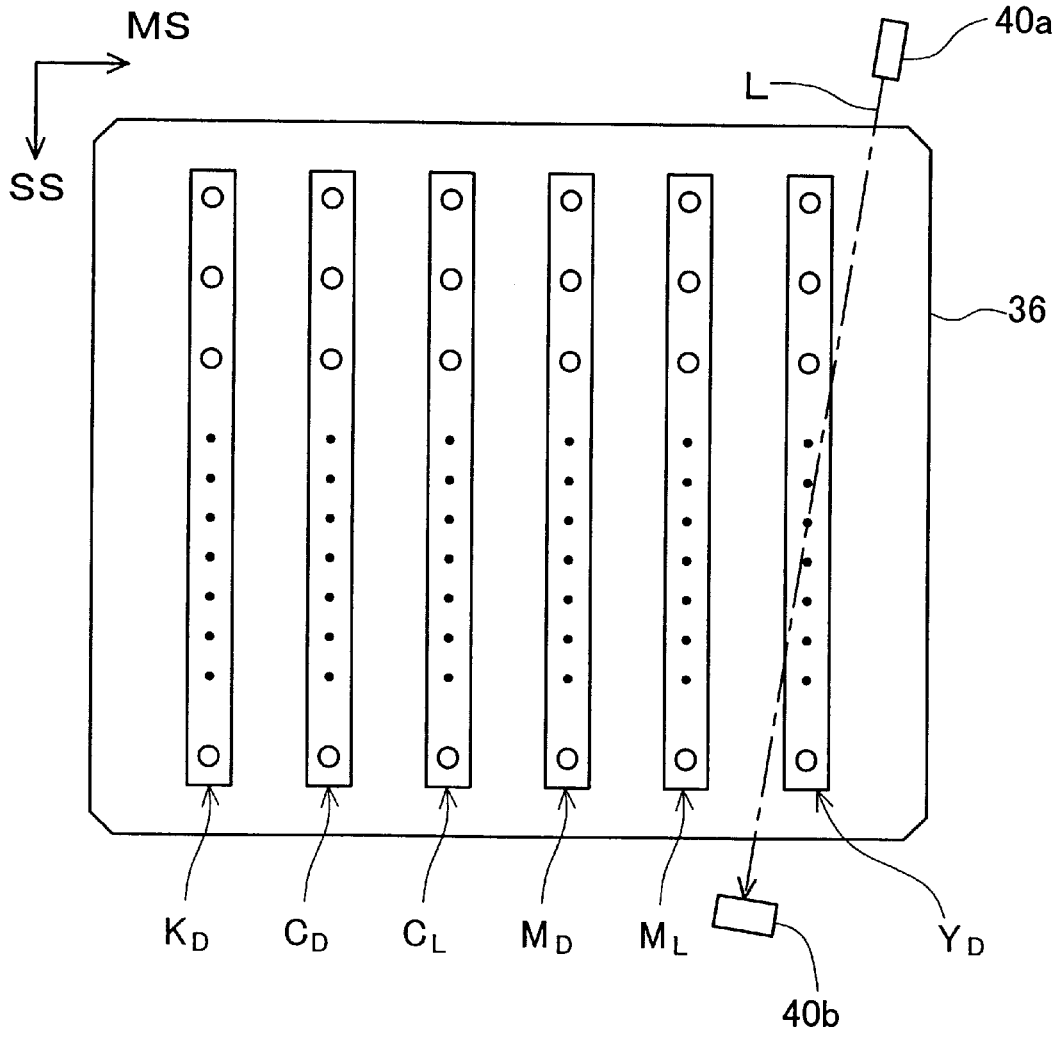
FIG. 3 is an explanatory drawing showing the construction of the dot dropout inspection unit 40 and the principle of the test method using such unit (mid-air drop test method).

FIG. 3 is an explanatory drawing showing the construction of the dot dropout inspection unit 40 and the principle of the test method used therein (flying ink droplet test method). In FIG. 3, the print head 36 is seen from the bottom, and a six-color nozzle array for the printer head 36 and the photo-emitter unit 40a and the photo-receptor unit 40*b* comprising the dot dropout inspection unit 40 are drawn.

Six nozzle groups are formed on the bottom surface of the print head 36. A black ink nozzle group $K_D$ expels black ink, a dark cyan ink nozzle group $C_D$ expels dark cyan ink, a light cyan ink nozzle group $C_L$ expels light cyan ink, a dark magenta ink nozzle group $M_D$ expels dark magenta ink, a light magenta ink nozzle group $M_L$ expels light magenta ink, and a yellow ink nozzle group $Y_D$ expels yellow ink.

The uppercase first letter in the symbol indicating each nozzle group refers to the color of the ink, while the subscript letter 'D' indicates that the ink is relatively dark, and the subscript letter 'L' indicates that the ink is relatively light. The subscript letter 'D' of the yellow ink nozzle group $Y_D$ means that the yellow ink expelled from this nozzle group creates a gray color when it is mixed with dark cyan ink and dark magenta ink in substantially equal proportions. The subscript letter 'D' of the black ink nozzle group $K_D$ means that the black ink expelled from these nozzles is not gray but is 100% dark black.

The multiple nozzles in each nozzle group are aligned along the sub-scanning direction SS. During printing, ink droplets are expelled from each nozzle while the print head 36 is moving in the main scanning direction MS together with the carriage 28 (FIG. 1).

The photo-emitter unit 40*a* includes a laser diode that emits a light beam L having an outer diameter of approximately 1 mm or less. The orientation of the photo-emitter unit 40*a* and the photo-receptor unit 40*b* is adjusted such that the direction of progress of the laser beam L is slightly inclined relative to the sub-scanning direction SS.

Dot dropout inspection is carried out by slowly moving the print head 36 in the main scanning direction at a certain speed while a laser beam L is emitted, and by sequentially driving the nozzles, which are the subject of the test, so that they expel ink droplets. This method offers the advantage that the clogging of the nozzles may be tested even if the ink droplets expelled from some of the nozzles deviate slightly from the standard position or direction.

C. First Embodiment

Figure 4:
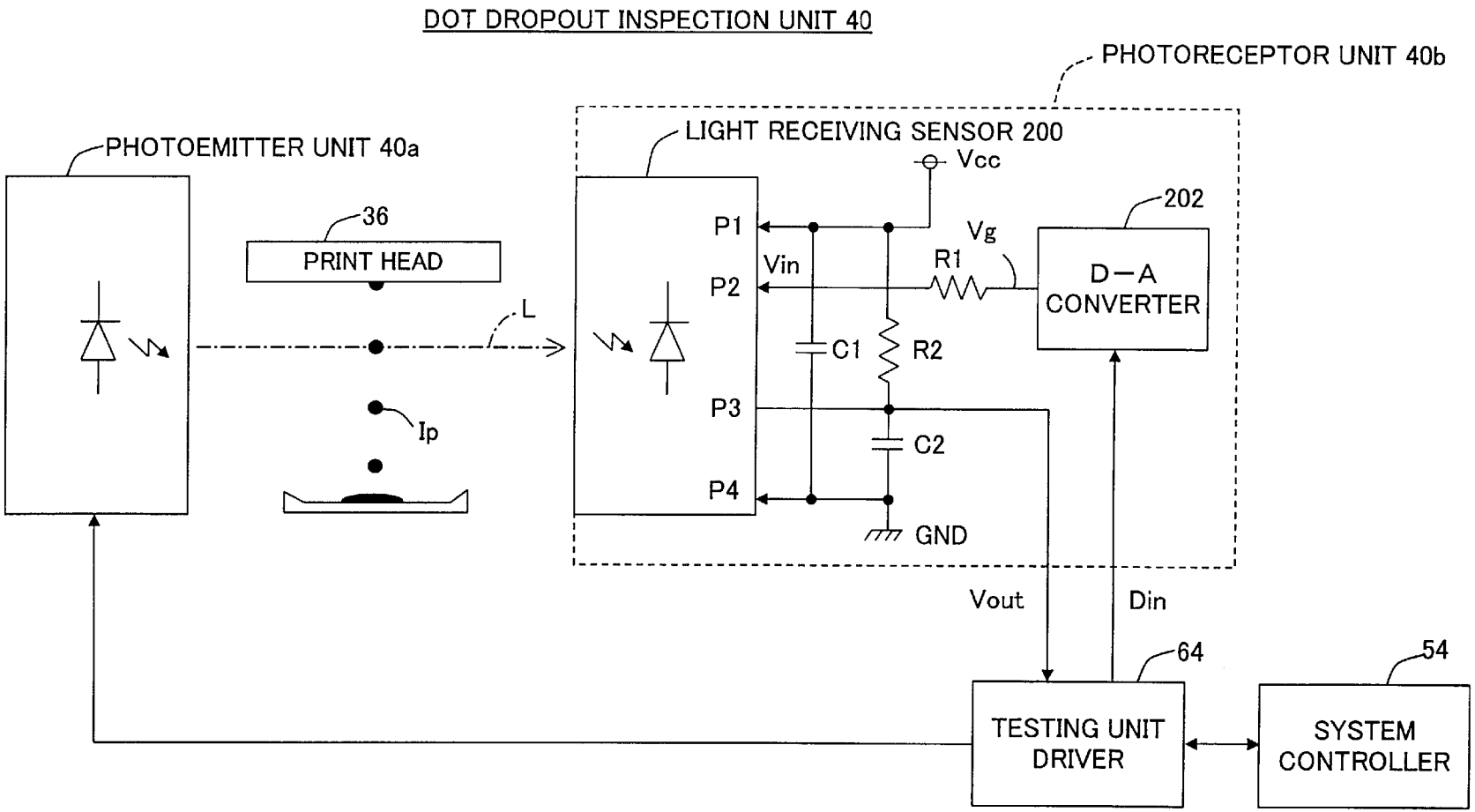
FIG. 4 is a block diagram showing the internal construction of the dot dropout inspection unit 40.

FIG. 4 is a block diagram showing the internal construction of the dot dropout inspection unit 40 in a first embodiment. The photo-receptor unit 40*b* comprises a photo sensor 200 and a D-A converter 202. The photo sensor 200 has a power supply terminal P1, a gain adjustment terminal P2, an output terminal P3, and a grounding terminal P4.

The power supply terminal P1 of the photo sensor 200 is connected to the power source voltage Vcc, and the grounding terminal P4 is connected to the ground voltage GND. The gain adjustment terminal P2 is connected to the D-A converter 202 via a resistor R1. A resistor R2 is connected between the output terminal P3 and the source voltage Vcc. A condenser C1 is connected between the power supply terminal P1 and the grounding terminal P4. A condenser C2 is also connected between the output terminal P3 and the grounding terminal P4.

The inspection unit driver 64 supplies a digital input signal $D_{in}$ to the D-A converter 202. The D-A converter 202 outputs a gain adjustment signal Vg having a voltage level corresponding to the level of the digital input signal $D_{in}$, and supplies the signal Vg to the gain adjustment terminal P2 of the photo sensor 200 via the resistor R1. On the other hand, an output signal Vout output from the output terminal P3 is supplied to the inspection unit driver 64.

The system controller 54 of the printer performs control of the dot dropout inspection unit 40 via the inspection unit driver 64. In other words, the system controller 54 and the inspection unit driver 64 have the function as a controller that controls the photo-emitter unit 40*a* and the photoreceptor unit 40*b*.

Figure 5:
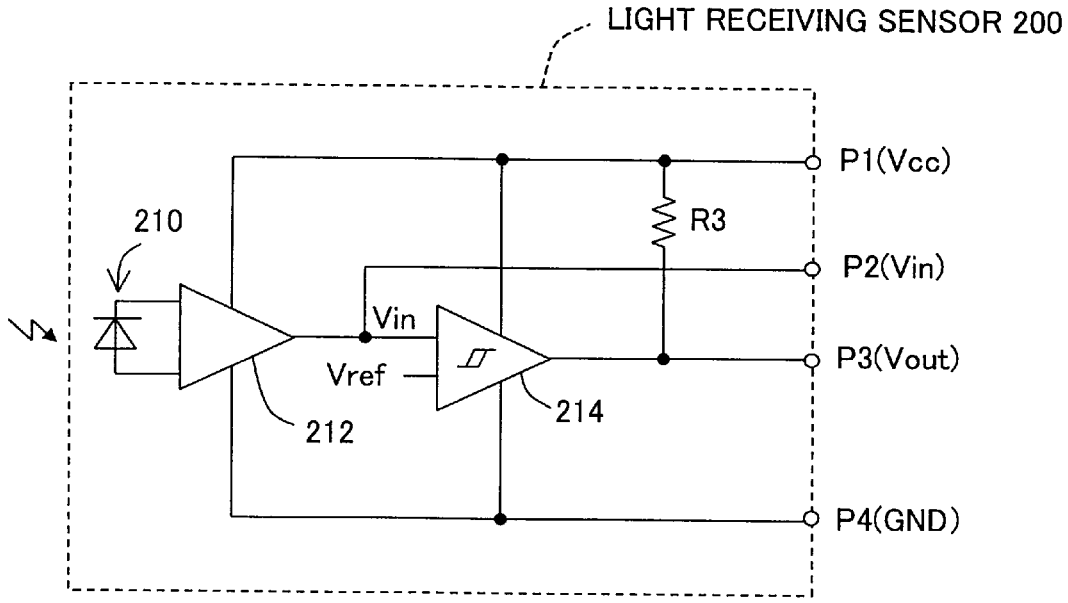
FIG. 5 is a block diagram showing the internal construction of the photo sensor 200.

FIG. 5 is a block diagram showing the internal construction of the photo sensor 200. The photo sensor 200 has a photodiode element 210, am amplifier 212 and a comparator 214. The power for the photodiode element 210 and the amplifier 212 is supplied via the power supply terminal P1 and the grounding terminal P4 of the photo sensor 200. The output terminal of the amplifier 212 and the gain adjustment terminal P2 of the photo sensor 200 are commonly connected to one of the two input terminals of the comparator 214. A reference voltage Vref is supplied to the other input terminal of the comparator 214. An output signal of the comparator 214 is given to the output terminal P3 of the photo sensor 200. The power supply terminal P1 and the output terminal P3 are connected via a resistor R3 inside the photo sensor 200.

Figure 6:
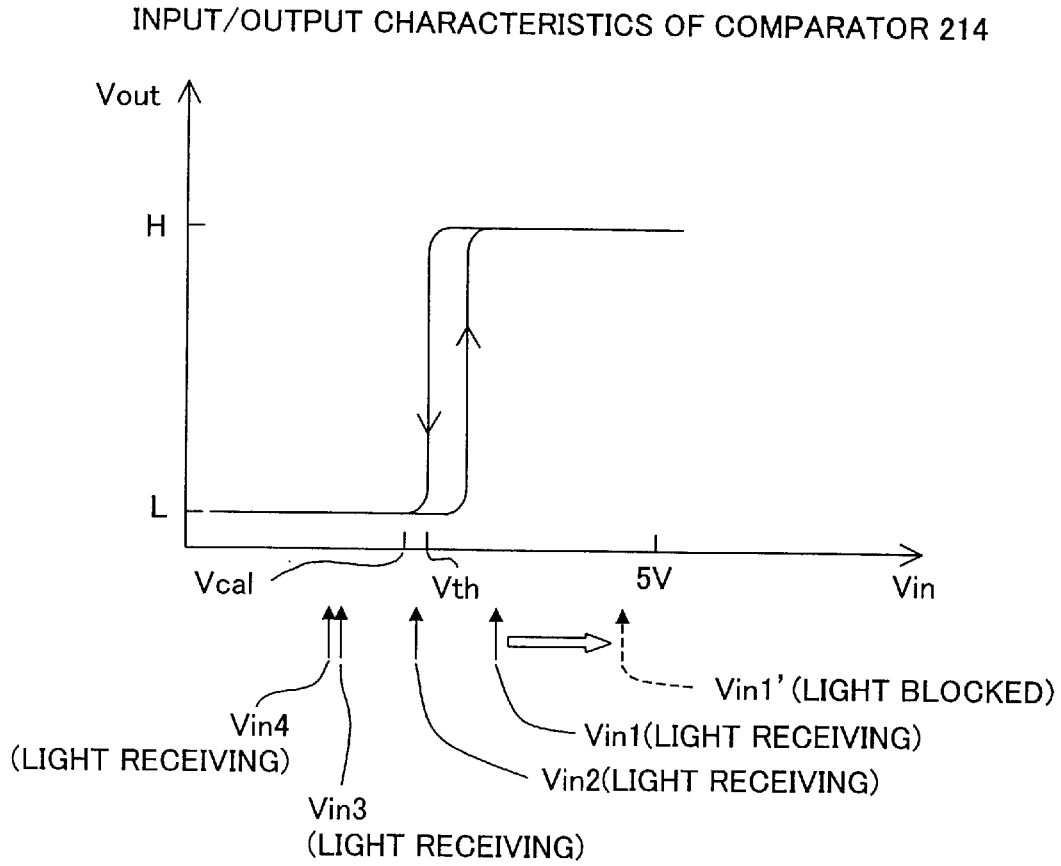
FIG. 6 is a graph showing the input/output characteristics of the comparator 214.

FIG. 6 is a graph showing the input/output characteristics of the comparator 214. This comparator 214 has a hysteresis characteristic; this type of comparator is called Schmidt circuit. When the input voltage Vin supplied to the comparator 214 decreases, at the point at which the input voltage Vin has become the level Vth, which is slightly lower than the reference voltage Vref, the output voltage $V_{out}$ switches from H level to L level. The level Vth of the input voltage Vin when the output voltage Vout switches from H level to L level will hereinafter be referred to as the 'threshold voltage'. The automatic gain adjustment explained below is performed using this threshold voltage Vth.

Figure 7:
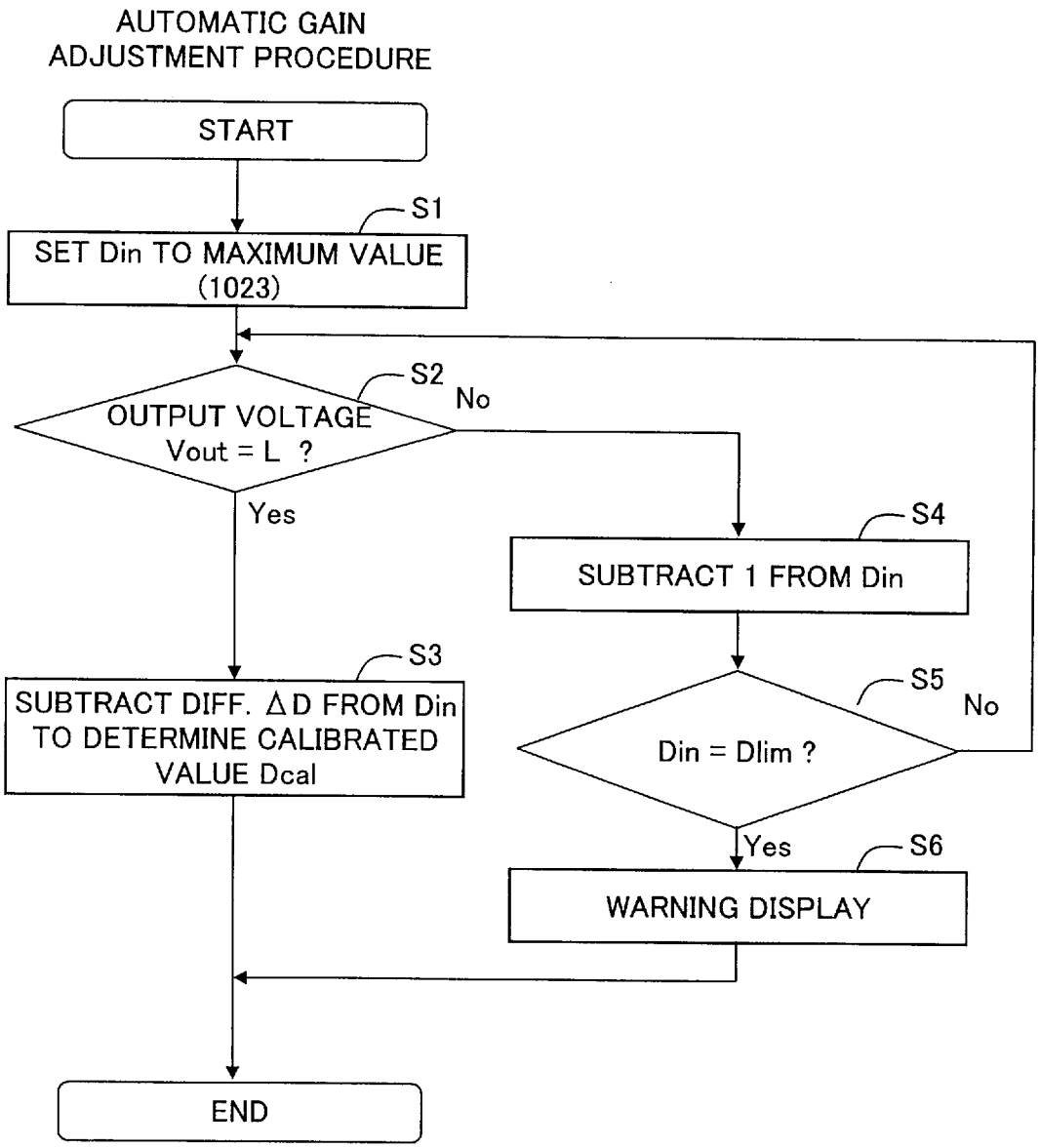
FIG. 7 is a flow chart showing the sequence of automatic gain adjustment performed by the dot dropout inspection unit 40.

FIG. 7 is a flow chart showing the procedure of the automatic gain adjustment of the dot dropout inspection unit 40. This automatic gain adjustment is realized by the system controller 54 executing the program stored in the main memory 56 (FIG. 2) before dot dropout inspection is carried out. The automatic gain adjustment is performed in the situation in which the photo-receptor unit 40*b* is intermittently receiving laser beams L and no ink droplets Ip are being expelled from the print head 36 (in other words, where no light receiving or ink expulsion is occurring).

In step S1, the digital input signals Din supplied to the D-A converter 202 are set to the maximum value of its dynamic range. For example, where the digital input signal Din is of 10 bits, a signal that indicates 1023 in decimal notation is input. When this occurs, a 5V gain adjustment voltage Vg is output from the D-A converter 202, for example, and is input to the photo sensor 200 via the resistor R1.

In step S2, it is determined whether or not the output voltage Vout from the photo sensor 200 has become L level. As can be seen from FIG. 6 described above, when the input voltage Vin supplied to the comparator 214 is close to 5V, the output voltage Vout from the comparator 214 (i.e., the output voltage of the photo sensor 200) indicates H level. Therefore, at the moment of step S2, which immediately follows the time at which the routine shown in FIG. 7 is begun, the output voltage Vout is H level. At this time, the system controller 54 advances from step S2 to step S4, and subtracts 1 from the digital input signal Din. In step S5, it is determined whether or not the value obtained as a result of the subtraction has reached the prescribed lower limit Dlim. If the value of the digital input signal Din has not reached the lower limit Dlim, the process returns to step S2. On the other hand, where the value of the digital input signal Din has reached the lower limit Dlim, a warning stating that automatic gain adjustment was unsuccessful is displayed in the printer panel (not shown in the drawings) in step S6, whereupon the process is ended.

The processes of steps S2, S4 and S5 are repeated until the output voltage Vout supplied from the photo sensor 200 switches from H level to L level. The output voltage Vout switches from H level to L level when the input voltage Vin supplied to the photo sensor 200 has become the threshold voltage Vth shown in FIG. 6.

When the output voltage Vout supplied from the photo sensor 200 switches to L level in step S2, step S3 is carried out. In step S3, a prescribed offset value (difference) ΔD is subtracted from the digital input signal Din the output voltage Vout has switched to L level, to make a calibrated value Dcal, whereby the digital input signal Din is set to the calibrated value Dcal appropriate for dot dropout inspection. Dot dropout inspection is performed while the digital input signals Din supplied to the D-A converter 202 is maintained at this calibrated value Dcal.

FIG. 6 also shows the voltage value Vcal of the input signals Vin supplied to the comparator 214 when a digital input signal Din having the calibrated value Dcal is input to the D-A converter 202 when no light reception or ink dot expulsion is occurring. This voltage value Vcal is lower than the threshold voltage Vth by a prescribed difference. By setting the input voltage Vin supplied to the comparator 214 to a voltage slightly lower than the threshold voltage Vth in this way, it can be successfully detected whether or not the light emitted from the photo-emitter unit 40*a* is blocked by the ink droplet Ip, as explained below.

Figure 8A:
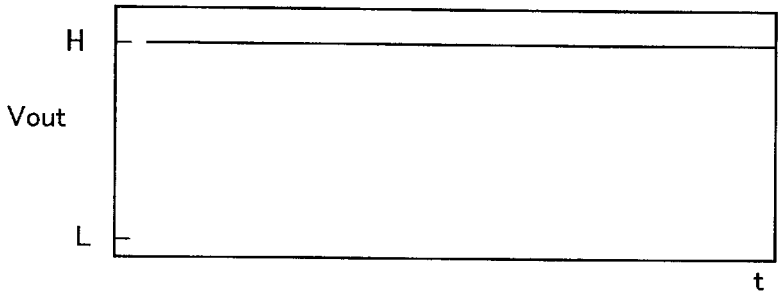
FIGS. 8(A)–8(D) show the relationship between the level of the gain adjustment signals Vg output from the D-A converter 202 and the detection operation by the photo sensor 200.

FIGS. 8(A)–8(D) show the relationship between the level of the input voltage Vin to the comparator 214 and the detection operation performed by the photo sensor 200 during light reception. FIG. 8(A) shows the results obtained when ink droplet expulsion testing was performed with the level of the input voltage Vin during light reception set to a value Vin1 (FIG. 6) that is higher than the threshold voltage Vth. In this state, if the laser beam is blocked by the ink droplet Ip, the input voltage Vin to the comparator 214 increases to Vin1' in FIG. 6. However, the output voltage Vout supplied from the photo sensor 200 at this voltage Vin1', which is achieved after the increase, is maintained at H level, and therefore the ink droplet Ip cannot be detected.

Figure 8B:
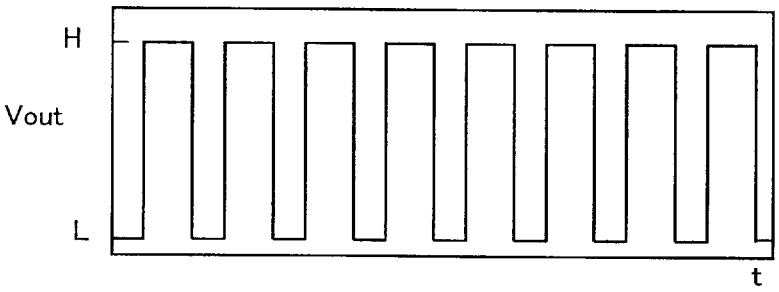

FIG. 8(B) shows the results obtained when ink droplet expulsion testing was performed with the input voltage Vin to the comparator 214 during light reception set to a value Vin2 (FIG. 6) that is slightly lower than the threshold voltage Vth. In this state, if the laser beam is blocked by the ink droplet Ip, the input voltage Vin to the comparator 214 increases, and as a result, the output voltage Vout supplied from the photo sensor 200 switches from L level to H level. Subsequently, when light reception is resumed, the output voltage Vout also returns from H level to L level. Therefore, as shown in FIG. 8(B), the output voltage Vout becomes H level when the laser beam is blocked by an ink drop, and becomes L level when the laser beam is not blocked. Consequently, the presence of ink droplets may be detected by checking this change between H level and L level.

The input voltage Vin2 shown in FIG. 8(B) is close to the threshold voltage Vth, and is the upper limit of the voltage by which the ink droplets may be individually detected. It is possible that, at this upper limit voltage Vin2, the ink droplets may no longer successfully detected if the measurement conditions fluctuate even slightly. Therefore, it is preferred that the appropriate voltage Vcal be set to a voltage lower than this upper limit voltage Vin2.

Figure 8C:
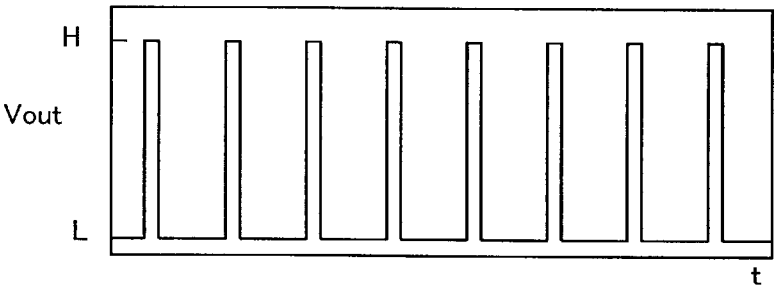

FIG. 8(C) shows a situation in which the input voltage Vin to the comparator 214 during light reception is the lower limit voltage Vin3 at which the ink droplets may be individually detected. In this case, while the ink droplets may be individually detected, the period of time in which the output voltage Vout stays H level is short, and therefore, it is possible that stable detection results may not be obtained. Therefore, it is preferred that the appropriate voltage Vcal be set to a voltage that is higher than this lower limit voltage Vin3.

Figure 8D:
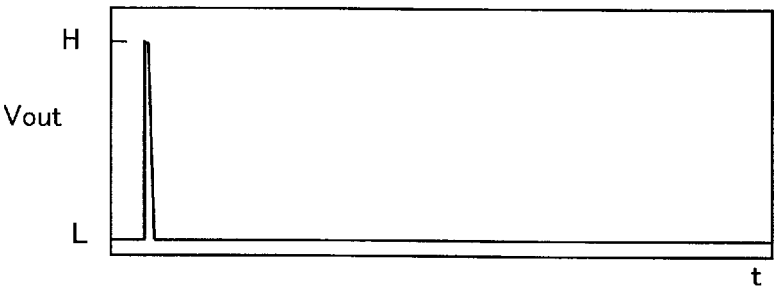

FIG. 8(D) shows a situation in which the input voltage Vin to the comparator 214 during light reception is the detection margin value Vin4. In this case, the ink droplets may or may not be detected. Therefore, it in not possible to detect them individually.

If the appropriate value Vcal for the input voltage Vin to the comparator 214 is set somewhere between the upper limit voltage Vin2 and the lower limit Vin3, individual ink droplets may be detected in a stable manner regardless of slight fluctuations in the measurement conditions.

The automatic gain adjustment process described above is preferably carried out immediately before dot dropout inspection is performed and each time dot dropout inspection is carried out. For example, where dot dropout inspection is performed each time the printer performs one pass of main scanning, automatic gain adjustment may be carried out after the one main scanning pass is completed and before dot dropout inspection is performed. Where dot dropout inspection is carried out each time printing of one page is performed, automatic gain adjustment may be carried out immediately before the dot dropout inspection is performed prior to the commencement of printing for one page. Where dot dropout inspection is carried out each time the printer is turned on, automatic gain adjustment may be carried out immediately after the turn-on and before the dot dropout inspection at the turn-on procedure.

As described above, in the first embodiment, the voltage supplied to the gain adjustment terminal P2 of the photo sensor 200 is adjusted to an appropriate value by means of the D-A converter 202, and therefore, even if there are substantial changes in the environment conditions, dot dropout inspection may be reliably performed.

The automatic gain adjustment is especially effective for the inspection unit 40 of a light-transmission type because the ink droplet expulsion testing has a fairly low S/N ratio. The low S/N ratio means that the appropriate range of the input voltage Vin, between Vin2 and Vin3, is narrow as shown in FIG. 6. When the environment conditions, such as the ambient temperature and the positional relation between the light beam and the ink droplet locus, are changed, a preset input voltage Vin may be out of the appropriate range. Even in this case, the automatic gain adjustment described above can set the input voltage Vin within an appropriate range under the current conditions.

D. Second Embodiment

Figure 9:
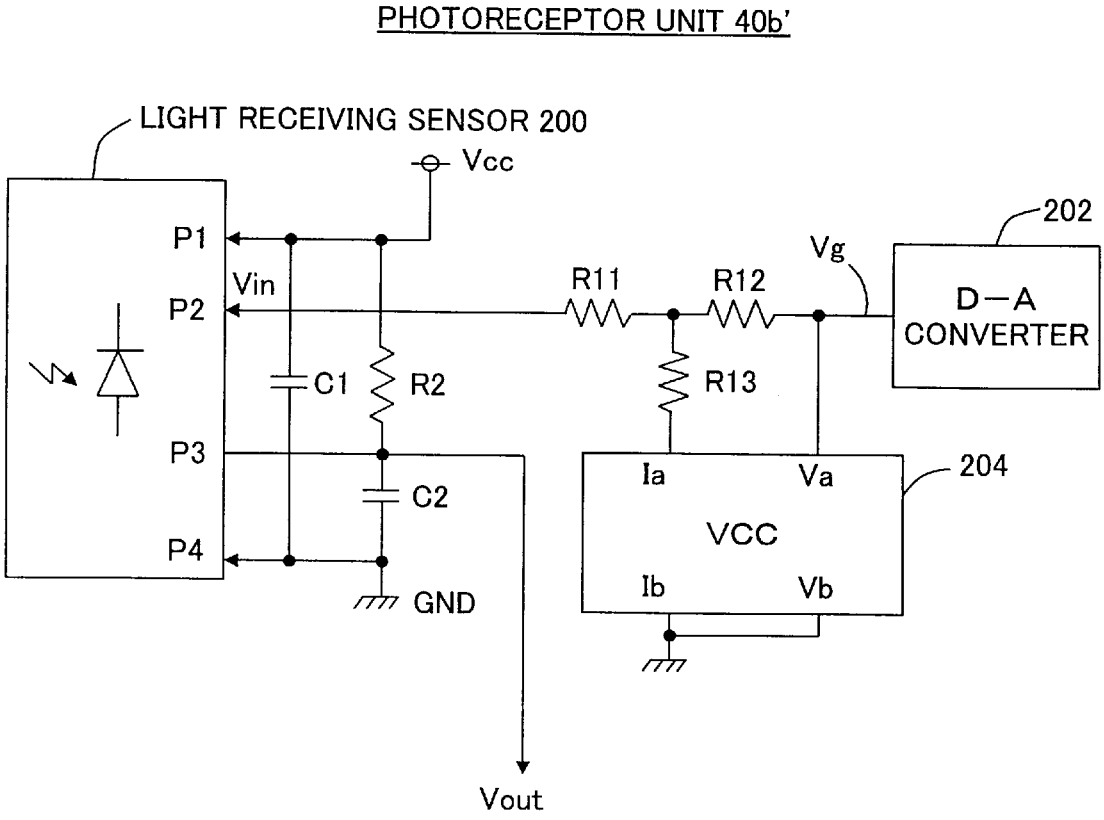
FIG. 9 is a block diagram showing the internal construction of the photo-receptor unit of the second embodiment.

FIG. 9 is a block diagram showing the internal construction of the photo-receptor unit in a second embodiment. This photo-receptor unit 40*b*' has, in addition to the photo sensor 200 and the D-A converter 202, a voltage controlled current source (VCC) 204. Two resistors R11 and R12 are serially connected between the gain adjustment terminal P2 of the photo sensor 200 and the D-A converter 202. A first current output terminal Ia of the voltage controlled current source 204 is connected to the nodal point between the two resistors R11 and R12 via a second resistor R13. Gain adjustment voltage Vg is input to the first voltage input terminal Va of the voltage controlled current source 204. The second voltage input terminal Vb and the second current output terminal Ib of the voltage controlled current source 204 are grounded. As a result, a current corresponding to the gain adjustment voltage Vg is output from the current output terminal Ia of the voltage controlled current source 204, and is supplied to the gain adjustment terminal P2. The construction of components other than these is the same as in the first embodiment.

Automatic gain adjustment may be carried out in this second embodiment in accordance with the sequence shown in FIG. 7 explained above, in the same way as in the first embodiment. However, using the construction of the second embodiment, the current that flows to the gain adjustment terminal P2 of the photo sensor 200 is supplemented by the voltage controlled current source 204, and therefore, the input voltage Vin level is made stable. As a result, more stable gain adjustment may be performed.

E. Third Embodiment

Figure 10:
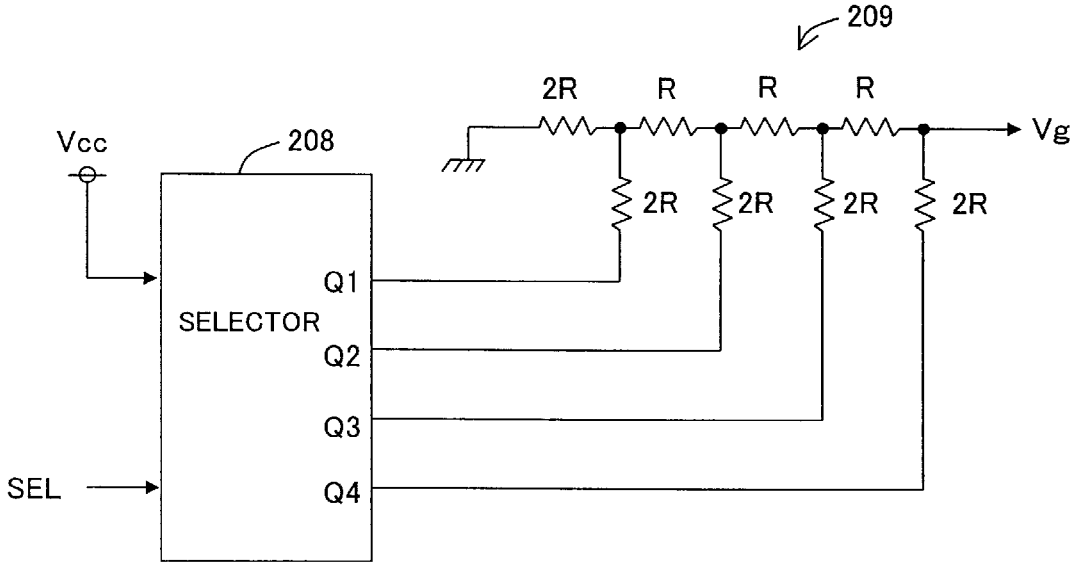
FIG. 10 is a block diagram showing the construction of the variable voltage supply circuit 206 used in the third embodiment.
Figure 11:
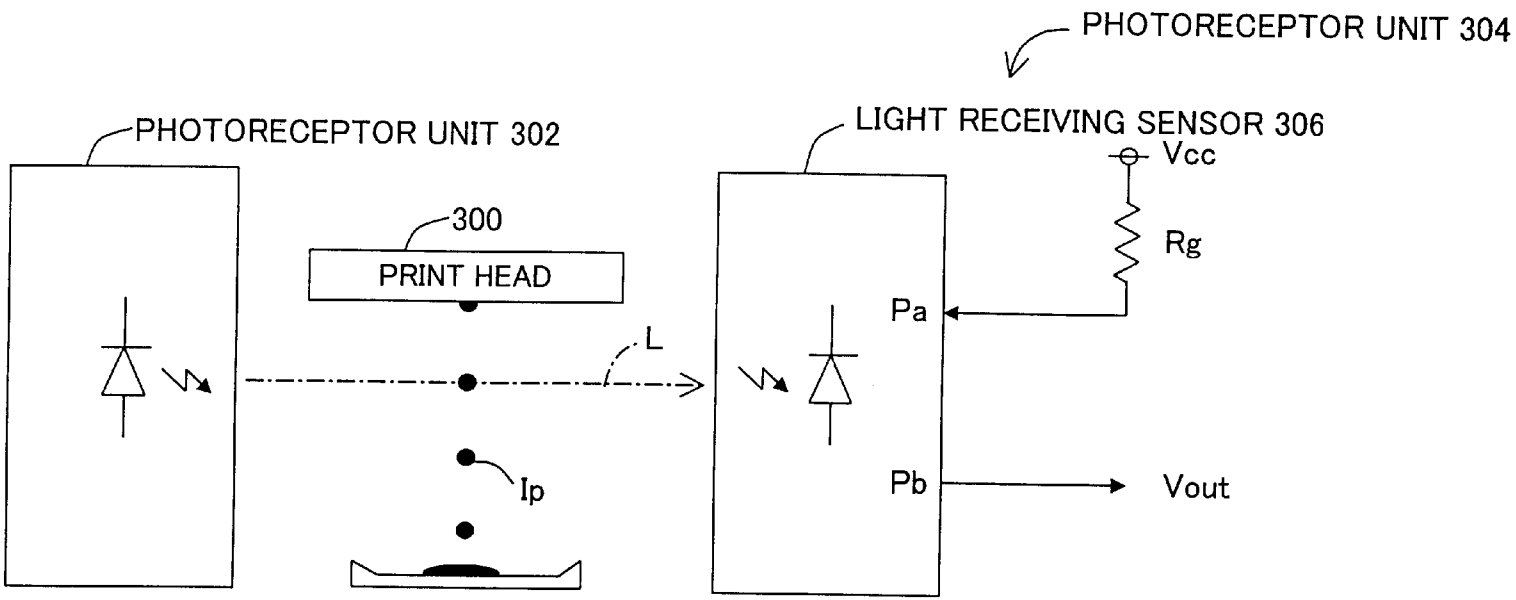
FIG. 11 is a conceptual drawing showing one example of a conventional ink droplet expulsion testing device.

FIG. 10 is a block diagram showing the construction of a variable voltage supply circuit 206 used in the third embodiment. This variable voltage supply circuit 206 may replace the D-A converter 202 in the first and second embodiments described above. The variable voltage supply circuit 206 comprises a selector 208 and a so-called ladder resistor unit 209 consisting of many resistors. The selector 208 selects one or more from among the four output terminals Q1 through Q4 in response to the selection signal SEL supplied from the inspection unit driver 64 (FIG. 4) or the system controller 54, and outputs a power source voltage Vcc from the selected output terminal(s). This power source voltage Vcc is divided by the ladder resistor unit 209 and is output as a gain adjustment voltage Vg.

Automatic gain adjustment may be performed in this third embodiment as well, in accordance with the same sequence as that shown in FIG. 7 described above. However, in the third embodiment, the selection by the selector 208 is alternated so that, instead of making subtractions from the digital input signal Din in FIG. 7, the gain adjustment voltage Vg decreases.

In the first and second embodiments described above, since the level of the gain adjustment voltage Vg is set using the D-A converter 202, the gain adjustment voltage Vg may be adjusted within a more precise adjustment range. Therefore, those embodiments have the advantage that the gain adjustment voltage Vg may easily be set to an appropriate calibrated value in response to the changes in the environment conditions.

F. Variations

F1. Variation 1

In the embodiments described above, during automatic gain adjustment, the gain adjustment voltage Vg supplied to the photo sensor 200 is reduced, and the threshold voltage Vth was determined by detecting the point at which the level of the output voltage Vout supplied from the photo sensor 200 changes. However, depending on the characteristics of the photo sensor 200, there are cases in which the threshold voltage Vth is sought while the gain adjustment voltage Vg is increased. In other words, generally speaking, for gain adjustment, it is acceptable if the threshold voltage Vth is sought while the gain adjustment voltage Vg is monotonically changed.

It is also possible to determine the appropriate calibrated value for the gain adjustment voltage Vg using other sequences. In other words, in general it is acceptable if the output voltage Vout supplied from the photo sensor 200 is detected while the voltage of the gain adjustment signals (variable voltage signals) Vg is varied, and the gain adjustment voltage Vg is set to an appropriate level for expulsion testing in accordance with the relationship between the voltage of the gain adjustment signal Vg and the output voltage level Vout.

F2. Variation 2

The construction realized by means of hardware in the above embodiments may be replaced by software, and conversely, part of the construction realized by means of software may be replaced by hardware.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A testing device to test whether or not ink droplets are expelled from a print head in a printer, comprising:

a photo-emitter unit configured to emit light such that the light crosses a locus of the ink droplets;

a photo-receptor unit configured to receive the light that has crossed the locus of the ink droplets, and a controller configured to control the photo-emitter unit and the photo-receptor unit;

wherein the photo-receptor unit includes:

(i) a photo sensor having a gain adjustment terminal and an output signal terminal; and (ii) a variable voltage supply unit configured to supply a variable voltage signal to the gain adjustment terminal, and wherein the controller detects an output signal from the output signal terminal of the photo sensor while changing a voltage level of the variable voltage signal output from the variable voltage supply unit, and sets the variable voltage signal to an appropriate level for the ink droplet expulsion test before the test is carried out, in accordance with the relationship between the voltage level of the variable voltage signal and the output signal of the photo sensor.

2. A testing device according to claim 1, wherein the variable voltage supply unit includes a D-A converter, the D-A converter having an input terminal for receiving a digital input signal and an output terminal for outputting the variable voltage signal, and wherein the controller adjusts the voltage level of the variable voltage signal output from the D-A converter by adjusting the digital input signal supplied to the D-A converter.

3. A testing device according to claim 2, wherein the variable voltage supply unit further includes a voltage controlled current source having a voltage input terminal and a current output terminal, the voltage input terminal being connected to the output terminal of the D-A converter, the current output terminal being connected to a node between the output terminal of the D-A converter and the gain adjustment terminal of the photo-receptor unit.

4. A testing device according to claim 3, wherein the controller executes:

(i) determining a threshold value at which a level of the output signal of the photo sensor changes from a prescribed first level to a prescribed second level while monotonically changing the digital input signal supplied to the D-A converter;

(ii) determining a calibrated value for the digital input signal by adding a prescribed difference to the threshold value; and (iii) inputting the digital input signal having the calibrated value to the D-A converter in order to set the variable voltage signal to an appropriate level.

5. A printer that performs printing by expelling ink droplets, comprising:

a print head to expel ink droplets; and a testing device configured to test whether or not ink droplets are expelled from the print head, the testing device including:

a photo-emitter unit configured to emit light such that the light crosses a locus of the ink droplets;

a photo-receptor unit configured to receive the light that has crossed the locus of the ink droplets, and a controller configured to control the photo-emitter unit and the photo-receptor unit;

wherein the photo-receptor unit includes:

(i) a photo sensor having a gain adjustment terminal and an output signal terminal; and (ii) a variable voltage supply unit configured to supply a variable voltage signal to the gain adjustment terminal, and wherein the controller detects an output signal from the output signal terminal of the photo sensor while changing a voltage level of the variable voltage signal output from the variable voltage supply unit, and sets the variable voltage signal to an appropriate level for the ink droplet expulsion test before the test is carried out, in accordance with the relationship between the voltage level of the variable voltage signal and the output signal of the photo sensor.

6. A printer according to claim 5, wherein the variable voltage supply unit includes a D-A converter, the D-A converter having an input terminal for receiving a digital input signal and an output terminal for outputting the variable voltage signal, and wherein the controller adjusts the voltage level of the variable voltage signal output from the D-A converter by adjusting the digital input signal supplied to the D-A converter.

7. A printer according to claim 6, wherein the variable voltage supply unit further includes a voltage controlled current source having a voltage input terminal and a current output terminal, the voltage input terminal being connected to the output terminal of the D-A converter, the current output terminal being connected to a node between the output terminal of the D-A converter and the gain adjustment terminal of the photo-receptor unit.

8. A printer according to claim 7, wherein the controller executes:

(i) determining a threshold value at which a level of the output signal of the photo sensor changes from a prescribed first level to a prescribed second level while monotonically changing the digital input signal supplied to the D-A converter;

(ii) determining a calibrated value for the digital input signal by adding a prescribed difference to the threshold value; and (iii) inputting the digital input signal having the calibrated value to the D-A converter in order to set the variable voltage signal to an appropriate level.

9. In a testing device to test whether or not ink droplets are expelled from a print head, using a photo-emitter unit that emits light such that the light crosses a locus of the ink droplets expelled from the print head, and a photo sensor that receives the light that has crossed the locus of the ink droplets, a method of adjusting the testing device comprising the steps of:

(a) before the ink droplet expulsion test, supplying a variable voltage signal to a gain adjustment terminal of the photo sensor while varying a voltage level of the variable voltage signal, and detecting an output signal from the photo sensor; and (b) setting a voltage level of the variable voltage signal to an appropriate level for the ink droplet expulsion test in accordance with the relationship between the voltage level of the variable voltage signal and the output signal of the photo sensor.

* * * * *